US005215499A

United States Patent [19]

Eberhardt

[11] Patent Number: 5,215,499

[45] Date of Patent: Jun. 1, 1993

[54] POSITIVE PRESSURE SAFETY SYSTEM

[75] Inventor: H. Alfred Eberhardt, Paoli, Pa.

[73] Assignee: Hale Fire Pump Company, Conshohocken, Pa.

[21] Appl. No.: 838,481

[22] Filed: Feb. 19, 1992

[51] Int. Cl.[5] ..... F24F 11/02

[52] U.S. Cl. ..... 454/256; 454/338

[58] Field of Search ..... 169/91; 454/238, 239, 454/251, 255, 256, 257, 258, 272, 338, 342

[56] References Cited

U.S. PATENT DOCUMENTS 3,952,452 4/1976 Hebda ..... 454/338 X
4,441,651 4/1984 Dill ..... 454/338 X
4,976,319 12/1990 Eberhardt et al. ..... 169/91 X

*Primary Examiner*—Harold Joyce
*Attorney, Agent, or Firm*—Frank A. Follmer

[57] ABSTRACT

A safety system for providing a positive pressure condition in an enclosed space to provide a safe freshair atmosphere in said enclosed space in response to the occurrence of an emergency condition which could introduce smoke or harmful gases into said enclosed space is disclosed.

11 Claims, 3 Drawing Sheets

POSITIVE PRESSURE SAFETY SYSTEM

FIELD OF THE INVENTION

This invention relates to a safety system for providing a positive pressure condition in an enclosed space to provide a safe fresh air atmosphere in said enclosed space in response to the occurrence of an emergency condition which could introduce smoke, harmful gases or other matter into said enclosed space. For example, the invention relates to maintaining a fresh air atmosphere in an enclosed fire escape tower of a tall building.

BACKGROUND OF THE INVENTION

In tall buildings having an enclosed fire escape, known as a fire tower, the occurrence of a fire will often result in smoke entering the fire tower by reason of the opening of doors leading to the fire tower by people attempting to escape a fire or by other means. The presence of smoke in the fire tower is a hazardous condition because it subjects those people who use the fire tower to escape the fire to poor visibility and because they are required to breath smoke-filled air.

A similar problem exists in many industrial applications, such as in clean rooms for the manufacturer of electronic products which would be damaged by the presence of smoke therein, in prisons wherein the prisoners are confined to cells and cannot escape the smoke produced by a fire, in chemical plants where workers can be subjected to exposure to a chemical leak, and in atomic power plants where workers could be subjected to radio-active steam and other radio-active material.

It is apparent there is a need to provide a system for maintaining an enclosed space under a positive pressure fresh air condition in the event of the occurrence of an emergency condition which could introduce hazardous gases or other material into said enclosed space.

DETAILED DESCRIPTION OF THE PREFERRED EMBODIMENT

Figure 1:
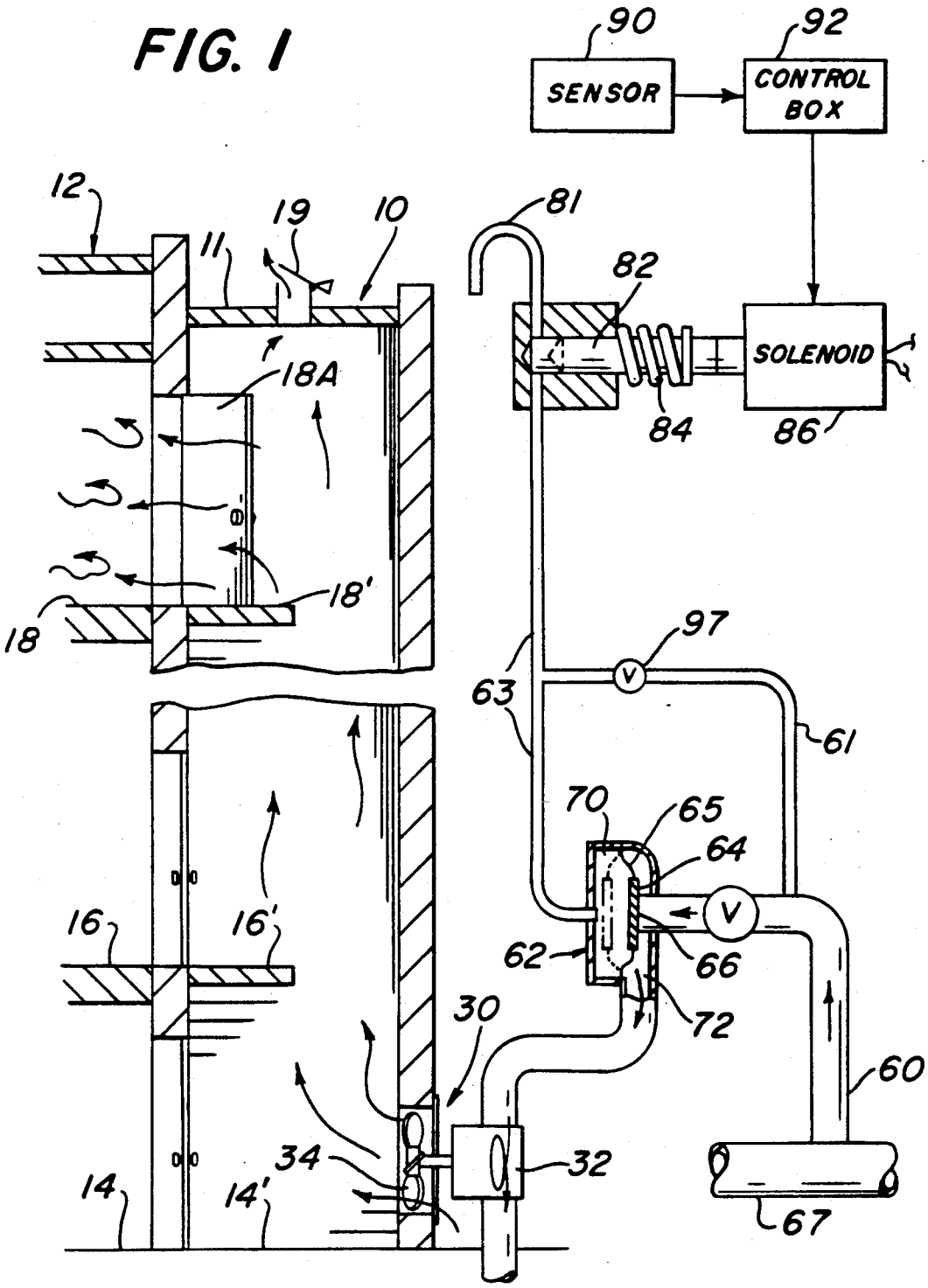
FIG. 1 is a schematic view of a positive pressure safety system in accordance with the invention as applied to a fire escape tower of a tall building.

In FIG. 1, there is shown a safety system in accordance with the invention for providing a positive pressure condition in an enclosed space, namely, an enclosed fire escape tower 10 of a tall building 12. Fire escape tower 10, as is conventional, extends throughout the vertical height of the building to provide an enclosed vertical chamber having a stairway therein extending from the bottom floor 14, past a plurality of intermediate floors 16 to the top floor 18 of the building 12. As shown in FIG. 1, there are provided doorways providing passage from each floor of the building to associated landings 14', 16', and 18' within the fire escape tower 10. This typical arrangement provides for escape exits from each floor of the building 12 in the case of a fire. As is illustrated in FIG. 1 at the top floor 18 of a fire escape 10, when someone wishes to exit the building 12 a fire emergency situation, they would open the door 18A pushing it into the tower 10 to provide access to the landing 18' and the stairway contained in the tower 10. The opening of a door 18A, of course, provides an opening for communication between the air in the building 12 and the air in the fire tower 10.

The roof 11 of fire escape tower 10 is provided with a simple pressure relief weighted flapper valve means 19 for a purpose to be described more fully hereafter.

Figure 2:
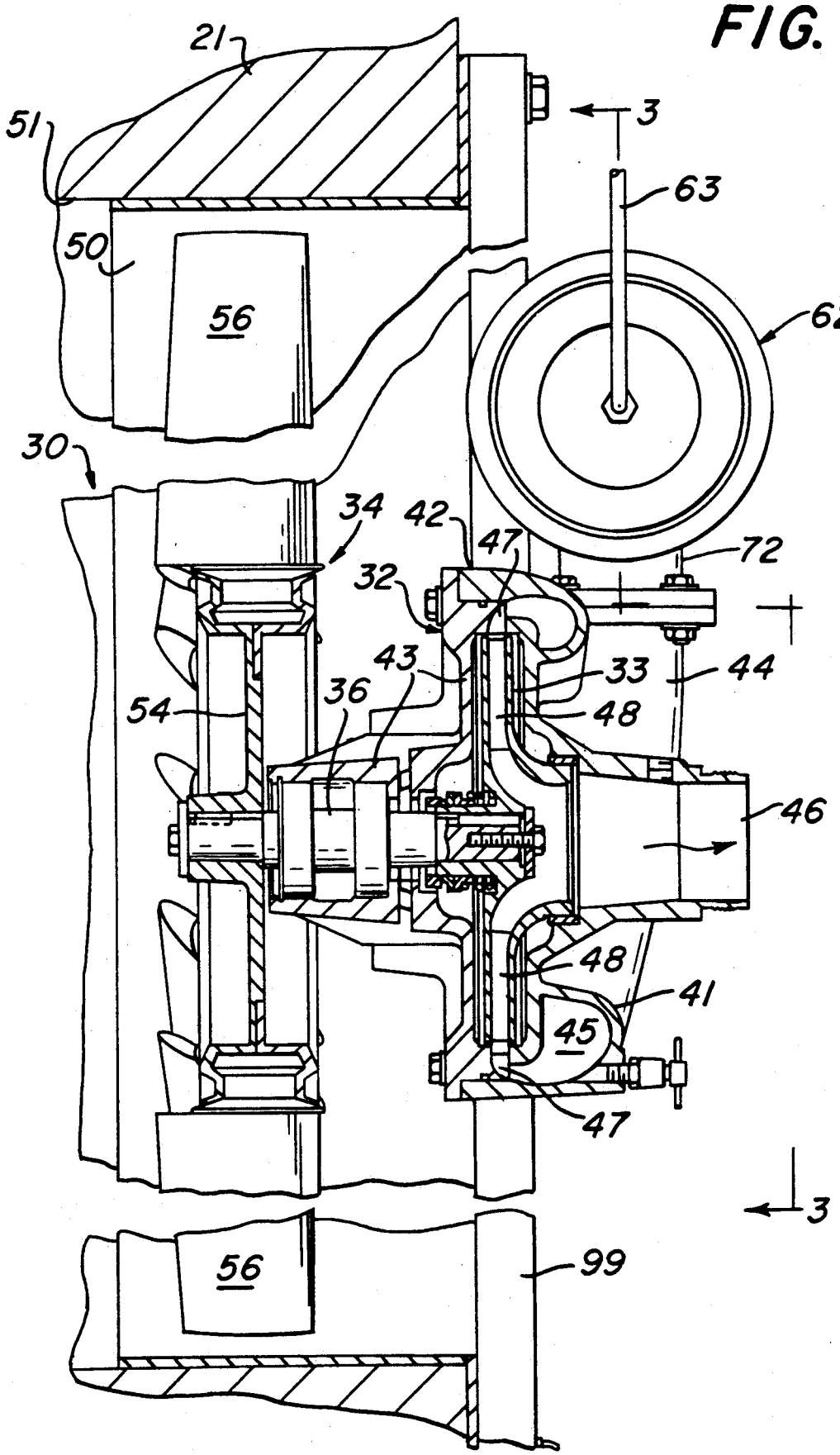
FIG. 2 is a fragmentary elevational view, partly in section, of a water driven fan for use in this system shown in FIG. 1.
Figure 3:
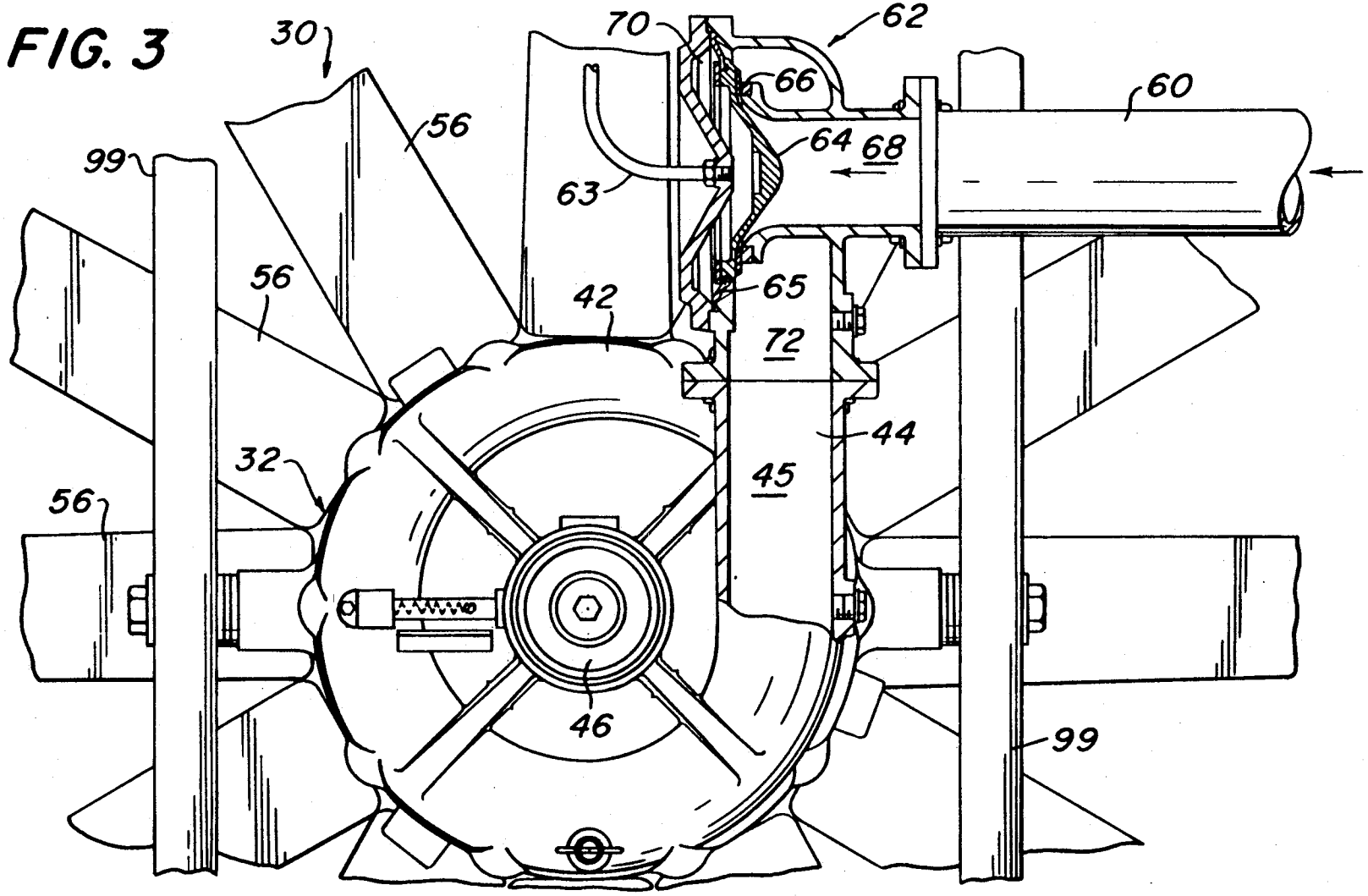
FIG. 3 is a sectional view taken generally on line 3—3 of FIG. 2.

The system of the invention comprises a fan means for blowing air into the enclosed space within the fire escape tower 10, such means comprising a water driven fan 30 disclosed in detail in FIGS. 2 and 3. Fan 30 is very similar in construction to the fan and turbine unit disclosed in U.S. Pat. No. 4,976,319 and manufactured by Hale Fire Pump Company, the common assignee of this application. Fan 30 includes a water-powered turbine 32 constructed and arranged to drive a fan 34 by way of a common shaft 36. Turbine 32 comprises a runner 33 on and keyed to one end of shaft 36 to rotate within the interior of a two-part turbine housing 42 which is provided with an inlet 44 and an outlet 46 for directing water into and out of housing 42. Turbine housing 42 comprises a rearwardly extending volute body 41 and a forwardly extending turbine head 43 which are connected together by bolts at mating surfaces suitably sealed by an O-ring seal. Shaft 36 is rotatably supported at a medial portion by a pair of ball bearings contained in head 43 of turbine housing 42. The turbine runner 33 is mounted on and keyed to the rearward end of shaft 36 by a conventional mounting arrangement. Fan 34 comprises a hub or rotor 54 mounted on and keyed to the forward end of shaft 36 by a conventional mounting arrangement.

Fan 34 is constructed to have twelve fan blades 56 mounted on the hub 54 at their bases so as to extend radially outwardly from the axis of shaft 36 at a desired pitch angle. The fan blades 56 are contained within a casing means 50 adapted to fit within an opening 51 in a vertical wall 21 of the fire tower 10. There is also provided a fan guard (not shown) for opening 51 in the form of an open wire-like configuration as is conventional in the art and a frame 99 for supporting the fan means in opening 51.

A typical fan in accordance with the invention comprises a twenty (output) horsepower water turbine 32 operating at 1750–2000 RPM and a fan 34 having a 30-inch diameter.

The design of the water turbine 32 is such that the water flow to cause rotation of runner 33 and the operation of the fan 34 is such that as the water under pressure enters the upstream end of an inlet chamber adjacent the inlet 44 of the fan housing 42, the water then flows through a volute chamber 45 in a generally circular converging scroll-like path around the upstream end of a nozzle ring and the water flows initially axially into the nozzle passages between guide vanes 47 and is then turned radially inwardly into the turbine vanes 48 of runner 33 to cause the runner 33 to rotate. The water flows through the runner 33 radially inwardly and is turned axially rearwardly to flow through an outlet 46 from which it is discharged from the unit. The rotation of the runner 33 causes the common shaft 36 to rotate thereby driving the hub 54 and the fan blades 56 to produce the air flow desired.

There is provided water supply means for delivering water under pressure to the inlet of water powered means for causing operation of the fan means. Such supply means comprises a supply line 60 and a valve 62 for controlling flow through said supply line. The supply line 60 has its upstream end connected to the fire main 67 or other suitable main source of water under pressure. As best shown in FIGS. 2 and 3, the control valve 62 is mounted on the housing of turbine 32 adjacent inlet 44 to control the flow of water from the supply line 60 to inlet 44 at the upstream end of the volute chamber 45. To this end, the control valve 62 comprises what is known in the art as a deluge valve and is mounted on the turbine housing adjacent inlet 44 by cooperating flange portions and mounting bolts as best shown in FIGS. 2 and 3. The deluge valve shown in the drawing is of a type well known in the art and comprises a quick opening valve member with only one moving part. The deluge valve comprises a valve seat 66 located at the downstream end of an inlet passage 68 which has its upstream end connected to the supply conduit 60 as is best shown in FIG. 3.

The deluge valve includes a control valve member 64 cooperable with the valve seat 66 for controlling flow therepast and means for mounting the valve member 64 for movement toward and away from the valve seat 66. To this end, the valve member 64 is mounted on a diaphragm 65 which cooperates with the valve member 64 and the housing of the valve 62 to define a control chamber 70 on the downstream side of the valve member 64. As is conventional, valve 62 has an outlet passage 72 which, along with control chamber 70, is separated from, or blocked from flow communication with, the inlet passage 68 by the valve member 64 which is kept closed against valve seat 66 by system pressure bypassed to the top chamber by way of flow lines 61 and 63. Under this condition, a pressure differential of about two to one maintains the control valve member 64 in a set closed against seat 66 position as shown in FIG. 3. This results from the different differential pressure areas on the upstream and downstream sides of the valve member 64 and its associated diaphragm 65 as is conventional in the art.

The valve member 64 is actuatable between the closed position shown in FIG. 3 preventing flow through the supply line 60 to the water driven turbine 32 and an open position permitting such flow, the open position being shown in dashed lines in FIG. 1. This actuation is achieved by the activation of a suitable detector, as will be described hereafter, whereupon the pressure in the control chamber 70 is lowered allowing the valve member 64 to open whereby water is allowed to flow from the supply line 60 through the valve 62 and to the water driven turbine 32 for causing operation of the same.

There is provided control means for actuating the control valve 62 from its closed position to its open position in response to the occurrence of an emergency condition. While this control means may take various forms, the control means shown in FIG. 1 includes means for sensing the occurrence of an emergency condition, namely a fire, and includes actuating means responsive to said control signal for actuating the control valve 62 from its closed to its open position. More specifically, such means comprises means for lowering the pressure in the control chamber 70 in the form of a solenoid-actuated control valve 80 which is constructed and arranged to open and close the flow line 63 connected to the control chamber 70. The control valve 80 comprises a valve member 82 movable from a first position in which the flow through the control valve 80 is closed off, ie., the solid line position shown in FIG. 1, and a second position in which the flow through the control valve 80 is permitted, ie., the dashed line position shown in FIG. 1. A compression spring 84 is provided to bias the valve member 82 toward said open position. There is also provided a solenoid means 86 constructed and arranged to overcome the bias of spring 84 and hold the valve member 82 in the closed position. By this arrangement, if the power should fail for any reason, which is not uncommon in the case of a fire, the spring 84 will move valve member 82 to the open position, which is the safety position of the system. A sensor 90 is connected through a control box 92 to deactivate the solenoid means 86 in response to the sensing of a fire condition. Thus, the sensor 90 may be a heat sensor, a smoke detector or other suitable fire detecting sensor. When the solenoid means 86 is deactivated, the valve member 82 is moved to its open position by spring 84 to thereby connect the control chamber 70 of the control valve 62 to atmosphere by way of a flow conduit comprising flow line 63, the open control valve 80 and a discharge pipe 81, it being noted that a valve 97 closes flow through line 61. It will be evident that such flow conduit not only subjects the water in control chamber 70 to atmospheric pressure, but also provides a flow passage through which the water in control chamber 70 can flow to drain. When this occurs, the higher pressure acting on the upstream side of valve member 64 by way of supply line 60 causes valve member 64 to move to the open or dashed line position shown in FIG. 1.

The lowering of the pressure in control chamber 70 and the resulting opening of the control valve 62 allows water from the supply line 60 to flow (as shown by the flow arrows in FIG. 1) through the control valve 62 and into the inlet 44 at the upstream end of the turbine volute 45 to thereby cause water turbine 32 to rotate and the fan 34 to operate to deliver air through the opening 51 in the wall 21 of the tower 10 and into the lower end thereof. This will cause the rapid production of a positive pressure condition in the interior chamber of the fire tower 10, which positive pressure condition will be maintained as long as the fan means is operative. The positive pressure condition within the fire tower 10 is controlled by way of the pressure relief valve 19 located in the roof 11 of the fire tower. Typically, the pressure relief valve 19 will allow air to be discharged from the fire tower 10 at a very low pressure of about one-quarter PSI.

In FIG. 1, there are provided a plurality of flow arrows which illustrate the flow conditions that are produced when a door 18A is opened during the operating condition of the system. As shown in this Figure, the positive pressure condition maintained within the fire tower 10 causes the air to flow in the direction from the fire tower internal space into the building 12 to thereby block the flow of any smoke from the building into the fire tower 10.

It will be noted that the system will remain in its activated condition until such time as it is reset by the operator of the system. In order to reset the system to its initial condition, the solenoid means 86 is operated to close the valve 80 by moving the valve member 82 against the bias of spring 84 thereon into the closed position shown in solid lines in FIG. 1. In addition, the control valve 97 in line 61 is opened to apply the high pressure water supply of the fire main 67 to the control chamber 70 which causes the valve member 64 to move to the closed or solid line position shown in FIG. 1, after which the control valve 97 is closed. The system is now set to be responsive to the sensing of an emergency condition to operate in the manner described above to provide a positive pressure condition when required.

What is claimed is:

1. A safety system for automatically providing a positive pressure condition in an enclosed space in response to the occurrence of an emergency condition comprising fan means for blowing air into said enclosed space to provide a positive pressure condition therein, water powered means for causing operation of said fan means in response to water supplied to an inlet thereof, said fan means and said water powered means being permanently installed in a stationary condition at a location in the vicinity of said enclosed space so as to be in place to provide said positive pressure condition in the event of the occurrence of an emergency condition, water supply means for delivering water under pressure to said inlet of said water powered means including a supply line, said and a valve for controlling flow through said supply line, said valve being constructed and arranged to be automatically actuatable between a closed position preventing flow through said supply line and an open position permitting flow through said supply line, and control means for automatically actuating said valve from said closed position to said open position in response to the occurrence of an emergency condition, said control means including means for sensing the occurrence of said emergency condition and providing a control signal and actuating means responsive to said control signal for actuating said control valve from said closed position to said open position, whereby water under pressure is delivered to said inlet of said water powered means to cause operation of said fan automatically to blow air into said enclosed space to provide a positive pressure condition therein.

2. A system according to claim 1 wherein said water powered means comprises a water driven turbine having an inlet and an outlet.

3. A system according to claim 2 wherein said valve for controlling flow through said supply line comprises a pressure responsive valve including a valve member movable between said closed position and said open position.

4. A system according to claim 3 wherein said pressure responsive valve has a control chamber normally maintained under a first pressure condition by said control means for urging said valve member to said closed position.

5. A system according to claim 4 wherein said control means causes the occurrence of a second pressure condition in said control chamber of said pressure responsive valve so that said valve member is moved from said closed position to said open position.

6. A system according to claim 1 including means for controlling the pressure condition within said enclosed space including a pressure relief valve arranged to allow air to be discharged therefrom at a set pressure.

7. A safety system according to claim 1 wherein said control means comprises an electrically energized means for holding said actuating means in a first position wherein said control valve is maintained in said closed position and mechanical means for biasing said actuating means for movement from said first position to a second position wherein said control valve is in said open position in response to the deenergization of said electrically energized means.

8. A safety system according to claim 7 wherein said mechanical means comprising a spring means.

9. A safety system according to claim 8 wherein said electrical means comprises a solenoid means.

10. A safety system for providing a positive pressure condition in an enclosed space comprising fan means for blowing air into said enclosed space to provide a positive pressure condition therein, water powered means for causing operation of said fan means in response to water supplied to an inlet thereof, said water powered means including a water driven turbine having an inlet and an outlet, water supply means for delivering water under pressure to said inlet of said water powered means including a supply line and a valve for controlling flow through said supply line, said valve being actuatable between a closed position preventing flow through said supply line and an open position permitting flow through said supply line, and control means for actuating said valve from said closed position to said open position in response to the occurrence of an emergency condition, said control means including means for sensing the occurrence of said emergency condition and providing a control signal and actuating means responsive to said control signal for actuating said control valve from said closed position to said open position, said valve including a valve member movable between said closed position and said open position and having a control chamber normally maintained under a first pressure condition by said control means for urging said valve member to said closed position, said control means causing the occurrence of a second pressure condition in said control chamber so that said valve member is moved from said closed position to said open position, whereby water under pressure is delivered to said inlet of said water powered means to cause operation of said fan to blow air into said enclosed space to provide a positive pressure condition therein.

11. A system according to claim 10 wherein said valve for controlling flow through said supply line comprises a deluge valve.

* * * * *